United States Patent [19]

Paliwoda

[11] 4,375,742

[45] Mar. 8, 1983

[54] ROOF INSULATION SUPPORT SYSTEM

[75] Inventor: Kenneth J. Paliwoda, Parma, Ohio

[73] Assignee: Metal Building Insulation-Southwest, Inc., Houston, Tex.

[21] Appl. No.: 159,777

[22] Filed: Jun. 16, 1980

[51] Int. Cl.[3] ..... E04B 1/74

[52] U.S. Cl. ..... 52/404; 52/463

[58] Field of Search ..... 52/479, 404, 488, 489, 52/463, DIG. 3, 407

[56] References Cited

U.S. PATENT DOCUMENTS

| | | | |
|---|---|---|---|
| 3,124,222 | 3/1964 | Mote | 52/463 |
| 3,553,915 | 1/1971 | Passovoy | 52/359 |
| 3,807,114 | 4/1974 | Ollinger | 52/489 |
| 4,117,641 | 10/1978 | Wells | 52/404 |
| 4,263,763 | 4/1981 | Bouwens | 52/404 |

FOREIGN PATENT DOCUMENTS

| | | | |
|---|---|---|---|
| 1216137 | 11/1959 | France | 52/463 |

*Primary Examiner*—John E. Murtagh
*Attorney, Agent, or Firm*—Pearne, Gordon, Sessions, McCoy & Granger

[57] ABSTRACT

An insulation system is disclosed for installing insulation in existing metal buildings. The system includes extruded hat-shaped support members having a central wall portion mounted on the lower flange of the building purlins with screw fasteners or the like. The support member provides oppositely extending shelf portions on which are mounted bridging members. The bridging members are slotted or notched at their ends and fit over the shelf portions for mounting. Insulation is positioned over the shelf portions and is supported along its sides by said shelf portions. In one embodiment, rigid insulation panels have ends which fit into channels on the bridging members. In another embodiment, faced insulation blankets extend over the bridging members and are supported at intervals along their length by the bridging members and along their sides by the shelf portions. In such latter embodiment, strips of adhesive secure the facing of the blanket to the bridging members and support members. The support members are provided with a lip which temporarily supports the support members along their length, first in a hanging position, and thereafter, in the installed position to which they are rotated. The support provided by such lip allows easy installation and facilitates the positioning of the support members until the fasteners are installed.

10 Claims, 12 Drawing Figures

FIG. 2
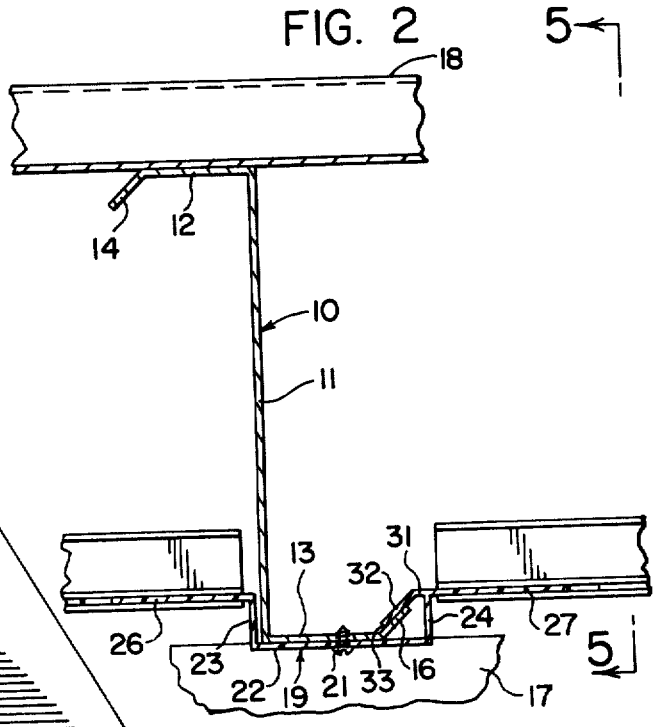
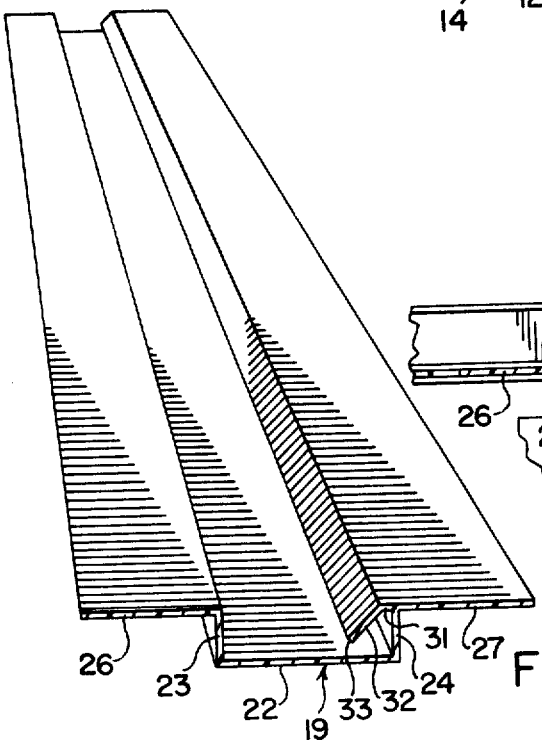
FIG. 3
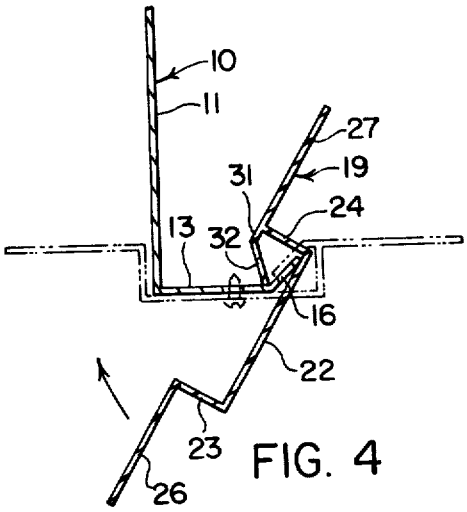
FIG. 4
FIG. 3A
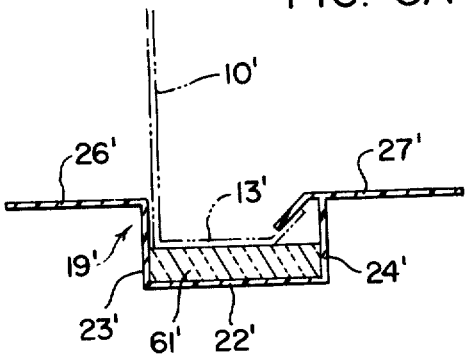

18"
10"
78"
79"
77"
71"
21"
22"
13"
19"
26"
9
72"
73"
74"
76"
27"

ROOF INSULATION SUPPORT SYSTEM

BACKGROUND OF THE INVENTION

This invention relates generally to insulated building structures, and more particularly, to a novel and improved insulation system adapted to be installed below the roof of an existing metal building or the like.

Prior Art

Metal buildings usually provide a corrugated roof supported by metal purlins which, in turn, are supported by, and extend perpendicular to, the principal frame system of the building, In the past, it has been common to insulate the roof of such building by installing insulation across or between the purlins prior to the installation of the roof sheets. Examples of such systems are described in U.S. Pat. Nos. 3,121,649; 3,969,863; and 4,047,346. Such systems, however, are not suitable for the installation of insulation in existing metal buildings because the previously installed roof panels prevent access from above.

In order to conserve energy, it is also desirable to provide a system for efficiently adding additional insulation to existing buildings, and systems are known to permit the installation of additional insulation from beneath the roof structure. Examples of these systems are disclosed in U.S. Pat. Nos. 4,044,521; 4,069,636; and 4,117,641. The present invention is directed to this latter type of insulation system.

SUMMARY OF THE INVENTION

The present invention is particularly suited for the installation of insulation in existing metal buildings having the plurality of purlins extending in parallel relationship between the basic frame system of the building and which support installed roof panels, such as corrugated metal panels. Such purlins provide a lower flange extending generally horizontally from a vertical web to an upwardly inclined lip at the free edge of the flange.

The present system provides elongated support members fastened, preferably by screws, to the lower flange and extending below the surface thereof to enclose the lower side of the purlins. Such support members provide oppositely extending shelf portions on opposite sides of the lower web. A plurality of spaced and parallel bridging members extend substantially perpendicular to the support members and are supported at their ends by the adjacent shelf portions. Elongated insulation means extends between adjacent purlins such that the insulation means is supported along its edges by the associated shelf portions and at intervals along the length thereof by the bridging members.

The support member is provided with a lip proportioned to overlay the edge of the lower flange and to suspend the support members along its entire length in a hanging position during its installation, and while it is rotated up into position to be fastened to the lower flange of the associated purlin. This structure greatly facilitates the installation of the support members, since it allows the installer working on a platform below the roof structure to easily position the support members for fastening to the lower flange of the purlin. Such fastening may, for example, be provided by self-tapping metal screws, or the like, which are positioned at intervals along the length of each support member.

In accordance with one embodiment of this invention, rectangular panels of relatively rigid insulation board material is placed upon the adjacent shelves and extends into channels provided by adjacent bridging members. Such rigid insulating panels provide support for additional insulation of the loose glass fiber blanket type, or the like, and cooperate with the support members and bridging members to provide an attractive and finished ceiling system.

In accordance in another embodiment of this invention, faced insulation blankets are positioned directly on the adjacent shelves and bridging members and the face is preferably secured by adhesive strips directly to such members so that the members and the facing cooperate to provide continuity of vapor barrier for the system. In addition, such adhesive tends to reduce the tendency for sagging to occur between bridging members and between the support shelves.

In accordance with still another embodiment of this invention, insulation is provided between the lower flange and the central wall portion of the support member to reduce or vertically eliminate the heat flow path otherwise provided by the metal purlins.

Each embodiment of the present invention provides a relatively simple, low cost and easily installed system for insulating existing metal buildings, or for increasing the amount of insulation of such buildings.

These and other aspects of the present invention are illustrated and described in the drawings and in the following specification.

BRIEF DESCRIPTION OF THE DRAWINGS

FIG. 2 is a fragmentary cross section illustrating a longitudinal support member mounted on the lower flange of a purlin and supporting bridging members extending substantially perpendicular to the support member at intervals along the length of the purlins;

FIG. 3 is a perspective of the support member illustrated in FIG. 1 prior to installation;

FIG. 3A is a fragmentary section similar to FIG. 2, but illustrating a modified support member in which insulation material is positioned between the lower flange of the purlin and the central portion of the support member;

FIG. 4 is a fragmentary perspective of the support member illustrated in FIGS. 2 and 3 and illustrating in full line the manner in which it is suspended from and supported along its length from the lower flange of the purlin and in phanthom line position after it has been rotated up to its installed position and fastened in such position;

DETAILED DESCRIPTION OF THE DRAWINGS

Figure 1:
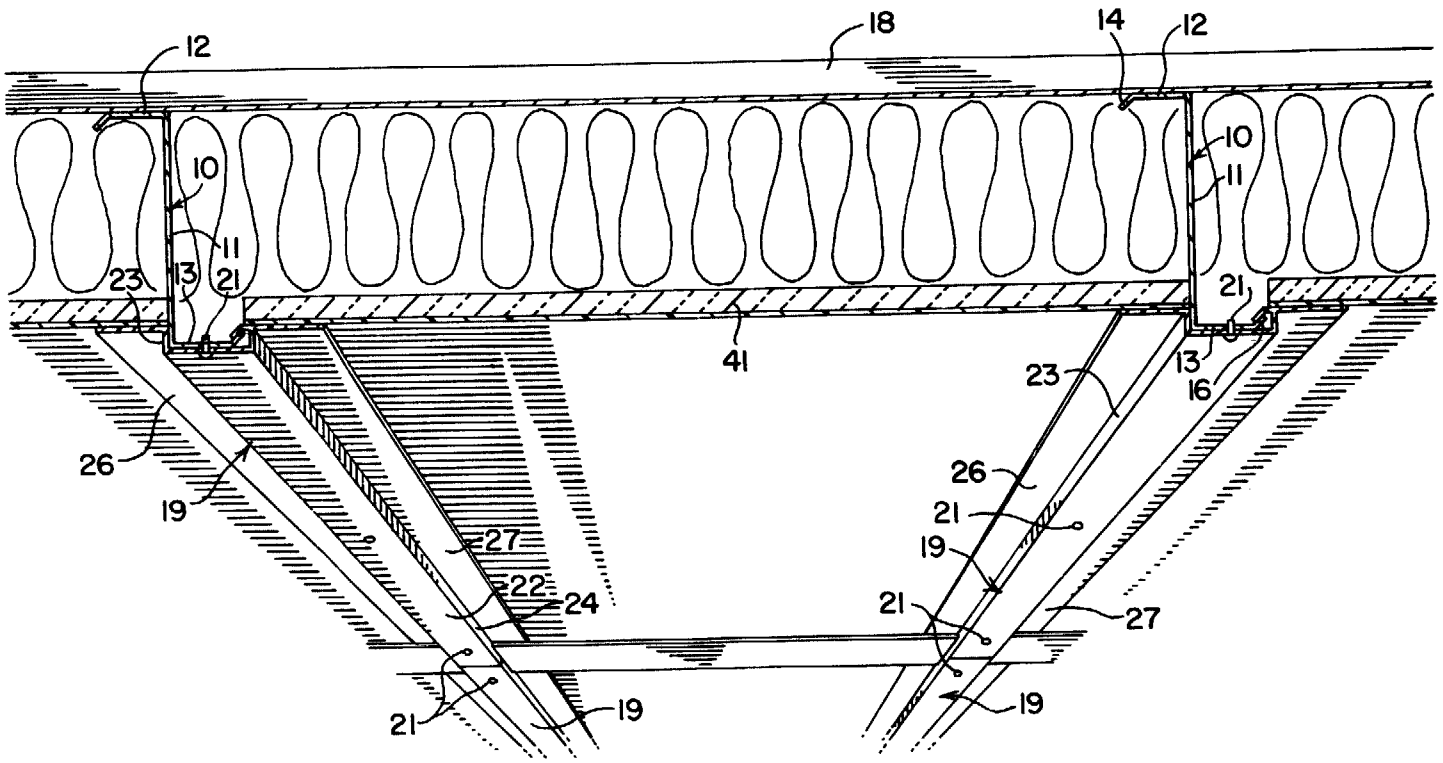
FIG. 1 is a fragmentary perspective view of an insulation installation in accordance with the present invention.

FIG. 1 illustrates a first embodiment of the present invention in which insulation is installed in an existing metal building. Such metal building includes a plurality of generally parallel purlins 10 each of which is formed with a vertically extending central web 11. Generally, the roof structure is inclined to provide roof pitch and the web portions normally extend substantially perpendicular to the plane of the adjacent roof. As used herein, the term "vertical" or "vertically extending" is intended to indicate and include a direction substantially normal to the roof plane, even if such plane is inclined to a substantial extent.

Oppositely extending upper and lower flanges 12 and 13, respectively, extend from the upper and lower edges of the central web 11. The purlins are provided with inclined lips 14 and 16 at the extremities of the flanges 12 and 13, respectively. These lips in the illustrated embodiment are inclined from the plane of the associated flange at about 45 degrees; however, in many instances purlins are produced with lips which extend substantially perpendicular to the associated flanges.

In a typical metal building, the purlins are supported by the main frame structure of the building, which is schematically illustrated by the frame member 17 in FIG. 2. In a typical building, the main frame system 17 includes a plurality of similar frame systems spaced along the length of the building and the portion of the building between adjacent frame systems is usually referred to as a "bay." The purlins extend across the bay and are supported by the main frame structure of the building, usually by fastening the lower flange 13 to the beams of the frame structure 17.

Positioned along the upper side of the purlins and supported by the purlins are the roofing panels 18 which are secured to the upper flange 12 by fastening means (not illustrated). In the drawings, the corrugated roofing panels are illustrated as mounted directly upon the purlins. However, in some instances, a layer of insulating material may be provided between the upper flange 12 and the roofing panels 18, as illustrated in some of the patents cited above.

In accordance with the first embodiment of the present invention, insulating structure is provided as illustrated in FIGS. 1 through 7. Such structure includes elongated support members 19 which are secured by spaced fasteners 21 to the lower flange 13 of the purlins 10. Such support members have a generally hat-shaped section including a central wall portion 22 which extends below the associated lower flange and joins with vertically extending side wall portions 23 and 24, that extend upwardly from the opposite edges of the central wall portion 22. Extending laterally from the upper edge of the side wall portion 23 is a first shelf portion 26 which is substantially parallel to the central wall portion 22. Extending laterally from the side wall portion 24 is a second shelf portion 27 which is preferably coplanar with the shelf portion 26 and extends in a direction opposite to the shelf portion 26.

The width of the central wall portion exceeds the width of the lower flange 13 and lip 16 so as to accommodate any bowing which might exist in the purlins, and also to allow sufficient adjustment to permit the support members to be equally spaced even if the spacing between the purlins is not completely uniformly maintained.

Referring to FIGS. 2 through 4, the support members 19 are provided with a lip which includes a short extension 31 of the shelf portion 27 extending inwardly beyond the side wall 24 and an inclined lip portion 32 extending downwardly toward the central wall portion 22 and away from the side wall portion 24. In the illustrated embodiment, the lip portion 32 is inclined at about 45 degrees. The edge 33 of the lip 32 is spaced from the central wall portion 22 to allow the support member 19 to be positioned over the lip 16 of the purlin, as best illustrated in FIG. 4. In fact, the structure is also arranged so that the support member can be positioned over a lip corresponding to the lip 16 even if such lip is vertical. The inward spacing of the upper edge of the lip 32 facilitates the use with vertical purlin lips.

The installation of the insulation system in accordance with this invention is accomplished by a workman or installer from beneath the roof and that such workman is often required to work on a relatively small scaffold platform; consequently, the presence of the lip 32 to assist in the installation of the support members is important to the ease of installation of the system. In practice, the support members 19 are positioned as shown in full line in FIG. 4, in a hanging position in which the support member is supported from the flange of the purlin throughout its length. It is then rotated up to the phantom line position in a manner which is essentially a pivotal movement until the central wall portion 22 engages the lower flange 13 of the purlin. Because the lip supports the support member along its entire length during and after such movement, the pivotal movement can be accomplished easily with one hand and the support member is held in such position while a fastener 21 is driven through the support member and into the flange. In the illustrated embodiment, the fastener is a self-tapping screw which can be driven with a power drive tool through the support member and flange without requiring separate drilling of the lead hole. However, other types of fasteners, such as rivets or the like, can be used if desired.

As soon as one fastener 21 is installed, the support member is held in its installed position, and it is a simple matter for the workman to move along its length and install additional fasteners since the lip 33 continues to support the remaining length of the support member. Preferably, fasteners 21 are installed substantially adjacent to each end of each support member, and, depending upon its length and rigidity, one or more fasteners can also be installed at an intermediate location, as illustrated in FIG. 1.

Figure 5:
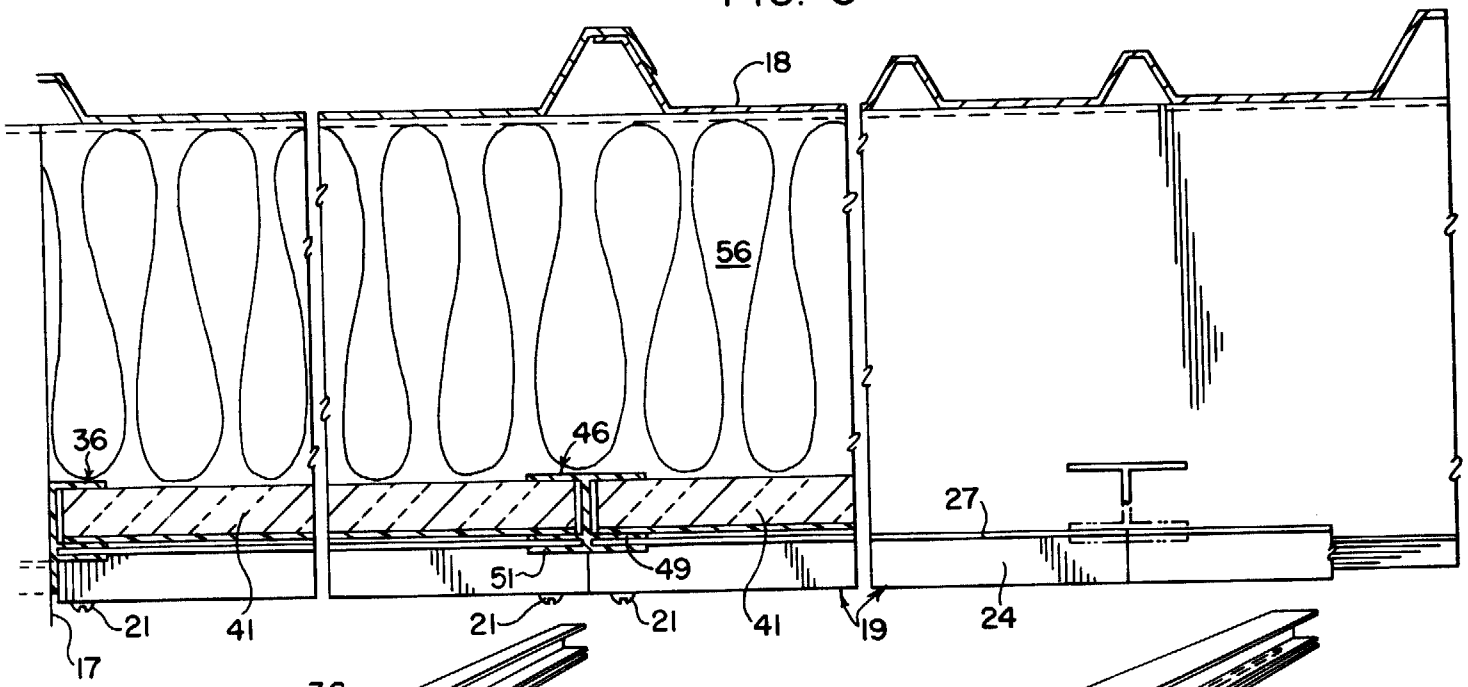
FIG. 5 is an enlarged fragmentary section illustrating in the left portion of the FIG., the fully installed insulation and in the right portion of the FIG., the system without the insulation.
Figure 6:
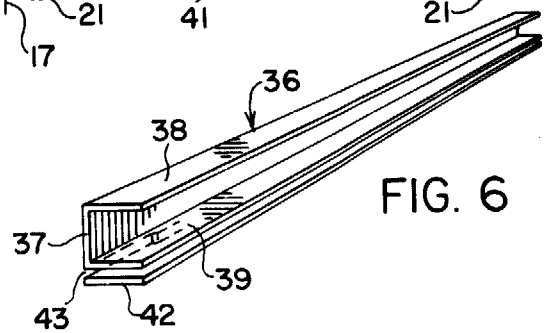
FIG. 6 is a fragmentary perspective view an end bridging member utilized at the ends of each bay.

As the next step of the installation, an end bridging member 36, as illustrated in FIGS. 5 and 6, is installed between adjacent support members at the end of a bay, where the frame member 17 usually interrupts the open spaces between adjacent purlins. Such bridging member 36 is formed with a vertical wall 37, from which extends spaced and parallel wall portions 38 and 39, which cooperate to form essentially a C-shaped channel or groove to receive the end of a piece of substantially rigid insulation board 41. The vertical wall 37 extends downwardly beyond the wall 39 to a lower wall portion 42, which is spaced from the wall portion 39 by a distance substantially equal to the thickness of the two shelf portions 26 and 37. The end of the wall portion 27 between the two walls 39 and 42 is notched out at 43 at both ends of the bridging member a sufficient distance so that the bridging member can be installed between two adjacent and associated shelf portions 26 and 27 of adjacent support members, so that the shelf portions extend into the groove to securely support the ends of the bridging on the adjacent support members 19.

Figure 7:
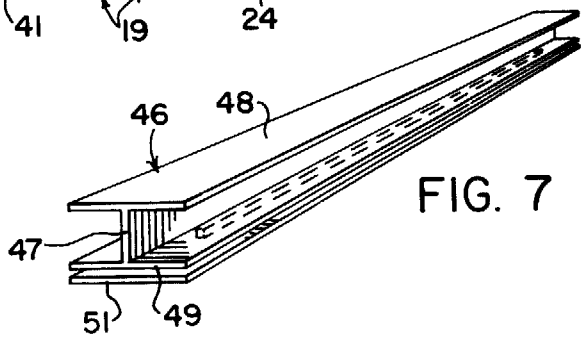
FIG. 7 is a fragmentary perspective view of an intermediate bridging member which is utilized between adjacent substantially rigid insulation panels.

Intermediate bridging members 46, best illustrated in FIGS. 5 and 7, are installed in a similar manner at spaced locations along the purlins between the ends of the bay. These intermediate bridging members are similar to the bridging members 36, but are symmetrical about a central wall 47 so that the upper horizontal wall 48 extends in both directions from the wall 47, as do the intermediate wall 49 and the lower wall 51. Consequently, the bridging member 46 provides two opposed, generally C-shaped channels or grooves, each of which is proportioned to fit over the edges of adjacent insulating board 41. Here again, the ends of the central wall 47 between the two walls 49 and 51 are notched back so that the bridging member can be installed on the adjacent shelf portions 26 and 27, with such adjacent shelf portions extending into the notch.

As best illustrated in FIGS. 1 and 5, loose blankets of insulation 56 are positioned on top of the insulating boards 41 between the purlins. In the drawings, the blankets 56 are illustrated as completely filling the space between the insulating boards 21 and the roof panels 18. However, this is not required, and thinner blankets can be used if desired, which would leave a space between the blankets and the roof panels. Similarly, if the insulation system in accordance with this invention is installed in a building already having insulation which was installed during erection of the building, a thinner blanket of appropriate thickness is used.

The preferred method of installing the insulation system in accordance with this invention involves the mounting of a pair of support members 19 on adjacent parallel purlins 10 at one end of the bay. A first bridging member 36 is then installed on the two shelf portions at the end of the bay. The insulation blanket is then pushed into the space between the purlins and a single piece of insulating board 41 is positioned on the shelf portion and moved axially into the channel of the bridging member 36.

As illustrated in FIG. 1, the width of the insulating board 41 should be sufficiently less than the spacing between adjacent webs 11 so that the board can be installed by first positioning the left edge as viewed in FIG. 1 over the shelf 27 and moved laterally toward the web 11 of the left-hand purlin 10 until the right edge of the panel clears the shelf 26, which is then raised up to a height above the shelf 26 while the panel is shifted to the right until it overlaps the shelf 26. The panel is then pushed axially into the channel provided by the bridging member 36.

After the first piece of insulating board 41 is installed, an intermediate bridging element 46 is mounted on the two shelf portions 26 and 27, pushed axially along the purlins until the free end of the panel board 41 slips into the adjacent channel of the intermediate bridging member. The installation procedure just mentioned above is then repeated to progressively complete the insulation along the entire length of the bay. Preferably, the insulating blanket 56 has a width substantially equal to the spacing between adjacent webs, even though the insulating boards 41 are narrower than such spacing by an amount at least equal to the width of one shelf portion.

Preferably, the boards or panels 41 have the same length as the support members so that the intermediate bridging members 46 also bridge across the ends of the shelf portions 26 and 27. This arrangement insures that the ends of adjacent shelf portions are aligned and also hides the joint therebetween. Further, the notched ends of the bridging members help support the load on the shelf portions by resisting any tendency for them to tip down.

The process described above is then repeated until all of the bays of the building are properly insulated, and when the installation is completed an attractive ceiling structure is provided in which the purlins are completely concealed and the bridging members in cooperation with the support members and insulating boards provide an effective vapor barrier and an attractive structure. If desired, the insulating boards 41 may be provided with any suitable facing material for appearance and/or vapor barrier purposes. Preferably, the support members and the bridging members are extruded of a relatively rigid plastic material having a relatively low thermal coefficient and attractive finish.

The depth of the support members determined by the length of the sidewalls 23 and 24 can be selected as desired to provide a varying space for the installation of the insulation. However, it is desirable to utilize the hat-shaped structure including the sidewalls 23 and 24, since such structure provides improved rigidity.

FIG. 3A illustrates a second embodiment in which similar reference numerals are utilized to designate similar parts and elements, but a prime is added to indicate that reference is being made to the embodiment of FIG. 3A.

In this embodiment, the support members 19' are provided with longer or deeper sidewalls 23' and 24' to provide a space between the central planar portion 22' and the lower flange 13 of a purlin 10 illustrated in phantom. In such embodiment, insulation material 61' is inserted in the channel so that it is positioned between the central planar portion 22' and the lower web 13' to limit the heat flow path through the metallic purlin 10'. Such insulating material 61' is preferably a relatively rigid foam insulation such as polystyrene foam or urethane foam. With such structure, the block of foam insulation 61' cooperates with the insulation above the shelf portions to provide virtually complete continuity of the insulating system.

Still another embodiment of this invention is illustrated in FIGS. 8 through 11. In such embodiment, a similar support member system and bridging member system is utilized; however, this system does not include a rigid insulation board but, instead, utilizes faced glass fiber blankets where the facing material is exposed to the interior of the building and means are provided to ensure a good vapor barrier throughout the installed system. In this embodiment, similar reference numerals are again utilized with a double prime (") to indicate reference to similar elements and portions thereof. Here again, spaced purlins 10" support the roof panels 18" and elongated inverted hat-shaped support members 19" are fastened to the lower flanges 13" by fasteners 21". The support members 19" are identical with the support members of the first embodiment, except for the fact that a strip of adhesive material 71" is provided along each of the shelf portions 26" and 27". The provision of a lip and a procedure for installation are identical, however, with the first embodiment.

The bridging elements differ in that they do not provide a C-shaped channel to receive the ends of insulation board, but merely provide two spaced wall portions 72" and 73". These wall portions are again spaced apart a distance substantially equal to the thickness of the shelf portions 26 and 27 and are notched out at their ends at 74" to allow the bridging members to be fitted over the ends of the associated shelf portions of the support members 19" in the same manner as in the first embodiment.

A depending flange 76" is provided on the bridging members to increase the rigidity thereof.

Figures 8, 9, 10, 11:
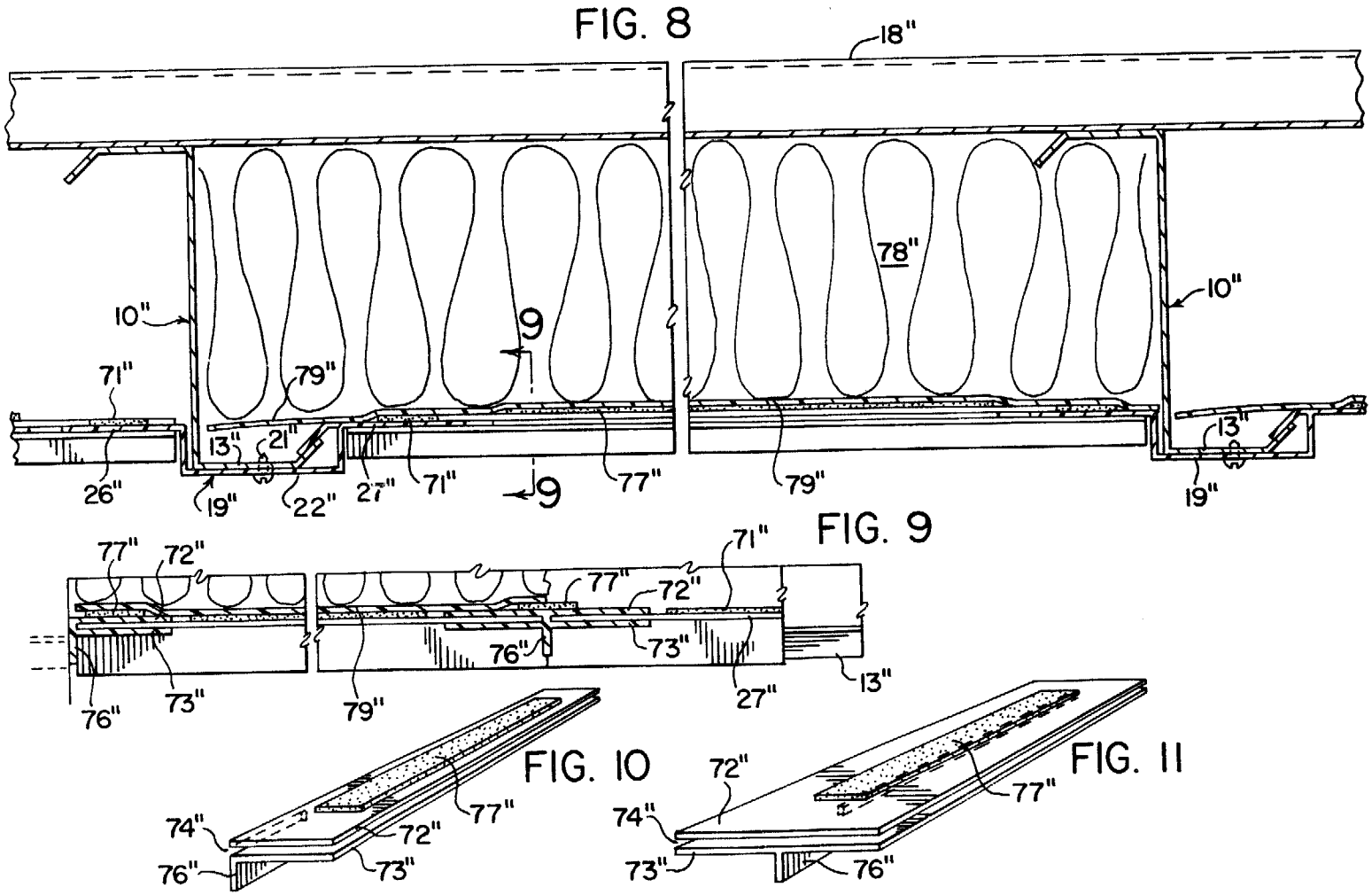
FIG. 8 is an enlarged fragmentary view of another embodiment in accordance with the invention wherein faced insulation blankets are directly supported by the support members and bridging members.
FIG. 9 is a fragmentary section taken generally along 9—9 of FIG. 8.
FIG. 10 is a fragmentary perspective view of an end bridging member for the system of FIG. 8.
FIG. 11 is a fragmentary perspective view of an intermediate bridging member for the system of FIG. 8.

FIG. 10 illustrates the bridging member intended to be used at the end of a bay in the manner described above in connection with the bridging member of FIG. 6, and FIG. 11 illustrates an intermediate bridging member corresponding to the intermediate bridging member of FIG. 7. Positioned along the upper surface of each of the bridging members is a strip of adhesive 77". It should be noted that it is preferable to provide the adhesive strips 71 and 77 with a covering of release tape which is removed during the installation of the system.

The installation of the embodiment of FIGS. 8 through 11 is similar to the first embodiment in that parallel support members 19" are installed and an end bridging member, as illustrated in FIG. 10, is installed on the shelf portions at the end of a bay. An insulation blanket 78" is then pushed into the space between the purlins above the shelf portions and at intervals along the length of the support members 19" intermediate bridging members, as illustrated in FIG. 11, are installed. The spacing between the bridging members is sufficiently small to ensure that the insulating blanket does not hang down significantly between the bridging members.

The insulating blanket 78" is provided with a vapor barrier facing 79" which may be formed of any suitable material such as vinyl or the like. As the system is installed, the release tapes (not illustrated) are removed from the adhesive strips 71" and 77" so that the facing 79" is permanently secured to the support members and bridging members. Because the material of the insulation blankets is compressible to some extent, it is possible to remove the release tapes and expose the adhesive to the facing after the various elements are properly positioned and tensioned. Once the facing is adhesively adhered to the support members, good continuity of the vapor barrier is provided. Usually the facing is selected to provide an attractive appearance which cooperates with the exposed support members and bridging members to provide an attractive ceiling appearance.

In each embodiment of the present invention, it is possible to economically and conveniently insulate the ceilings of existing metal buildings from below the roof without excessive scaffolding or the like. In fact, with the present invention it is possible for a single workman to perform all of the steps required for the insulation of such a ceiling structure. Because the lips on the support members permit the support members to be supported throughout their length while the fasteners are installed, it is not difficult for a single workman to install such support members even if the support members are relatively long. Further, the use of mechanical fastening means, such as self-tapping screws or the like, ensures that a permanent mechanical connection is provided and that the support members cannot slip off the purlins. This positive mechanical connection provides greater security than is provided in the some of the prior art systems disclosed in the patents cited above. Further, since the various elements of the system can be formed by simple extrusion processes from relatively low cost plastic materials, an economical system is provided.

Although the preferred embodiment of this invention has been shown and described, it should be understood that various modifications and rearrangements of the parts may be resorted to without departing from the scope of the invention as disclosed and claimed herein.

What is claimed is:

1. A building structure comprising a plurality of parallel purlins providing a generally vertical web and upper and lower flanges extending from opposite edges of said web, roof panels supported above said purlins, an elongated support member fastened to said lower flange and extending below the lower surface thereof, said support member providing oppositely extending shelf portions on opposite sides of said lower web, a plurality of spaced and parallel bridging members extending substantially perpendicular to said support members and mounted at their ends on adjacent shelf portions, and elongated insulation means extending between adjacent purlins, said insulation means being supported along its edges by said shelf portions and at intervals along its length by said bridging members, said support members including a lip portion operable to overlie an edge of said lower flange to suspend said support member along its length in a hanging position during installation thereof and while it is rolled up into its installed position for fastening to said lower flange, said shelf portions being substantially coplanar, said support members providing a central wall extending below said lower flange and below the plane of said shelf portions, and a pair of spaced substantially perpendicular side walls joining the outer ends of said central wall and the inner sides of the associated shelf portion, the spacing between said side walls being greater than the width of said lower flange to accommodate variations in the spacing between said purlins.

2. A building structure as set forth in claim 1, wherein said lip extends from the inner edge of one of said shelf portions toward said central wall and terminates at a free edge space from said central wall and the adjacent side wall.

3. A building structure as set forth in claim 2, wherein said lip is inclined away from said adjacent side wall at an angle of about 45°.

4. A building structure as set forth in claim 3, wherein said central wall is mounted on said lower flange substantially entirely by screws located at intervals along the length of said central wall.

5. A building structure as set forth in claim 3, wherein insulation is positioned between said lower flange and said central wall.

6. A building structure as set forth in claim 3, wherein a block of foam insulation is positioned between said lower flange and said central wall.

7. A building structure comprising a plurality of parallel purlins providing a generally vertical web and upper and lower flanges extending from opposite edges of said web, roof panel supported above said purlins, an elongated support member fastened to said lower flange and providing a central wall extending below the lower surface thereof, said support member providing a pair of spaced and substantially parallel side walls extending upwardly from the opposite edges of said central wall and a pair of substantially coplanar shelf portions extending in opposite directions from each of said side walls, the spacing between said side walls being greater than the width of said lower flange to accommodate variations in the spacing of said purlins, a plurality of spaced and substantially parallel bridging members extending substantially perpendicular to said support members and providing notches at their ends which fit over said shelf portions to mount said bridging members on said shelf portion, and elongated insulation means extending between adjacent purlins, said insulation means being supported along its edges by said shelf portions and at intervals along its length by said bridging members.

8. A building structure as set forth in claim 7, wherein said bridging members provide channels, and said insulation means includes substantially rigid panels supported along their sides by said shelf portions and having ends extending into said channels.

9. A building structure as set forth in claim 7, wherein said insulation means includes an elongated insulation blanket provided with a vapor barrier facing, and strips of adhesive on said shelf portions secure said facing to said shelf portions along the length of said blankets.

10. A building structure as set forth in claim 9, wherein a strip of adhesive extends along the upper surface of each of said bridging members and secures said facing to said bridging members.

* * * * *